US006702721B2

(12) United States Patent
Schroeder

(10) Patent No.: US 6,702,721 B2
(45) Date of Patent: Mar. 9, 2004

(54) BICYCLE TRAINER WITH MOVABLE RESISTANCE DEVICE

(75) Inventor: Duane G. Schroeder, New Hope, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 248 days.

(21) Appl. No.: 09/766,864

(22) Filed: Jan. 19, 2001

(65) Prior Publication Data

US 2001/0041648 A1 Nov. 15, 2001

Related U.S. Application Data

(60) Provisional application No. 60/177,494, filed on Jan. 21, 2000.

(51) Int. Cl.[7] ..... A63B 69/16
(52) U.S. Cl. ..... 482/61; 482/57
(58) Field of Search ..... 482/61, 62, 112, 482/57; 434/61; 211/21

(56) References Cited

U.S. PATENT DOCUMENTS

| | | | | | |
|---|---|---|---|---|---|
| 5,026,047 | A | | 6/1991 | Kosecoff | 272/73 |
| 5,042,795 | A | | 8/1991 | Bursik | 272/73 |
| 5,108,092 | A | | 4/1992 | Hurst | 482/60 |
| 5,433,681 | A | * | 7/1995 | Minoura | 482/61 |
| 5,611,759 | A | | 3/1997 | Zeh et al. | 482/61 |
| 5,800,316 | A | * | 9/1998 | Huang | 482/61 |
| 5,916,068 | A | * | 6/1999 | Chisholm et al. | 482/61 |
| 5,944,637 | A | | 8/1999 | Stickler et al. | 482/61 |
| 6,203,472 | B1 | * | 3/2001 | McCaffrey et al. | 482/61 |

* cited by examiner

*Primary Examiner*—Nicholas D. Lucchesi
*Assistant Examiner*—Tam M. Nguyen
(74) *Attorney, Agent, or Firm*—Westman, Champlin & Kelly, P.A.; S. Koehler

(57) ABSTRACT

An exerciser adapted for use with a pedaled device includes a frame having a post support ends for supporting the pedaled device and a frame mounting flange. A resistance device is selectively securable to the frame mounting flange in a first position relative to the opposed support ends. An adapter is selectively securable to the frame mounting flange and has an adapter mounting flange such that when the adapter is secured to the secured mounting flange, the resistance device is securable to the adapter mounting flange.

12 Claims, 6 Drawing Sheets

BICYCLE TRAINER WITH MOVABLE RESISTANCE DEVICE

CROSS-REFERENCE TO RELATED APPLICATION

This application claims priority to U.S. Provisional Application Serial No. 60/177,494, filed Jan. 21, 2000, which is hereby incorporated by reference in its entirety.

BACKGROUND OF THE INVENTION

The present invention relates generally to exercise equipment, and more particularly, to a bicycle trainer.

Bicycle trainers have been used by bicycle enthusiasts to convert their bicycles for stationary riding. A typical user is a bicycle owner who competes in various bicycle races or rides often. When the weather prevents riding outdoors, such as it is raining, too cold or too hot, the cyclist can use the trainer indoors to simulate a ride. In some cases, cyclist may want to use a trainer while also reading or watching television. However, in all cases, the bicycle trainer should be easy to use and simulate bicycle riding. A common bicycle trainer has a frame onto which the user mounts the bicycle. Typically, the rear wheel of the bicycle is in contact with a roller that, in turn, is coupled to a resistance unit. The roller is supported by the frame at a fixed distance from couplers that engage and support the bicycle in an upright position. In this manner, the bicycle trainer is generally designed to work with bicycles of a particular wheel diameter. Some cyclists however may enjoy riding types of bicycles, i.e., bicycles with large diameter wheels as well as bicycles with small diameter wheels. Likewise, a family may desire bicycle trainer that can accommodate bicycles having different wheel diameters.

SUMMARY OF THE INVENTION

An exerciser adapted for use with a pedaled device includes a frame having a post support ends for supporting the pedaled device and a frame mounting flange. A resistance device is selectively securable to the frame mounting flange in a first position relative to the opposed support ends. An adapter is selectively securable to the frame mounting flange and has an adapter mounting flange such that when the adapter is secured to the secured mounting flange, the resistance device is securable to the adapter mounting flange.

A second aspect of the present invention is an adapter for mounting a resistance device on a frame of an exerciser used to support a pedaled device. A frame includes a frame mounting flange for mounting the resistance device and spaced apart frame portions. The adapter includes a portion adapted for mounting to the frame mounting flange. The portion includes an adapter mounting flange to which the resistance device is mountable. The adapter further includes a support member having ends engagable with the spaced apart frame portions.

DETAILED DESCRIPTION OF THE ILLUSTRATIVE EMBODIMENTS

Figure 1:
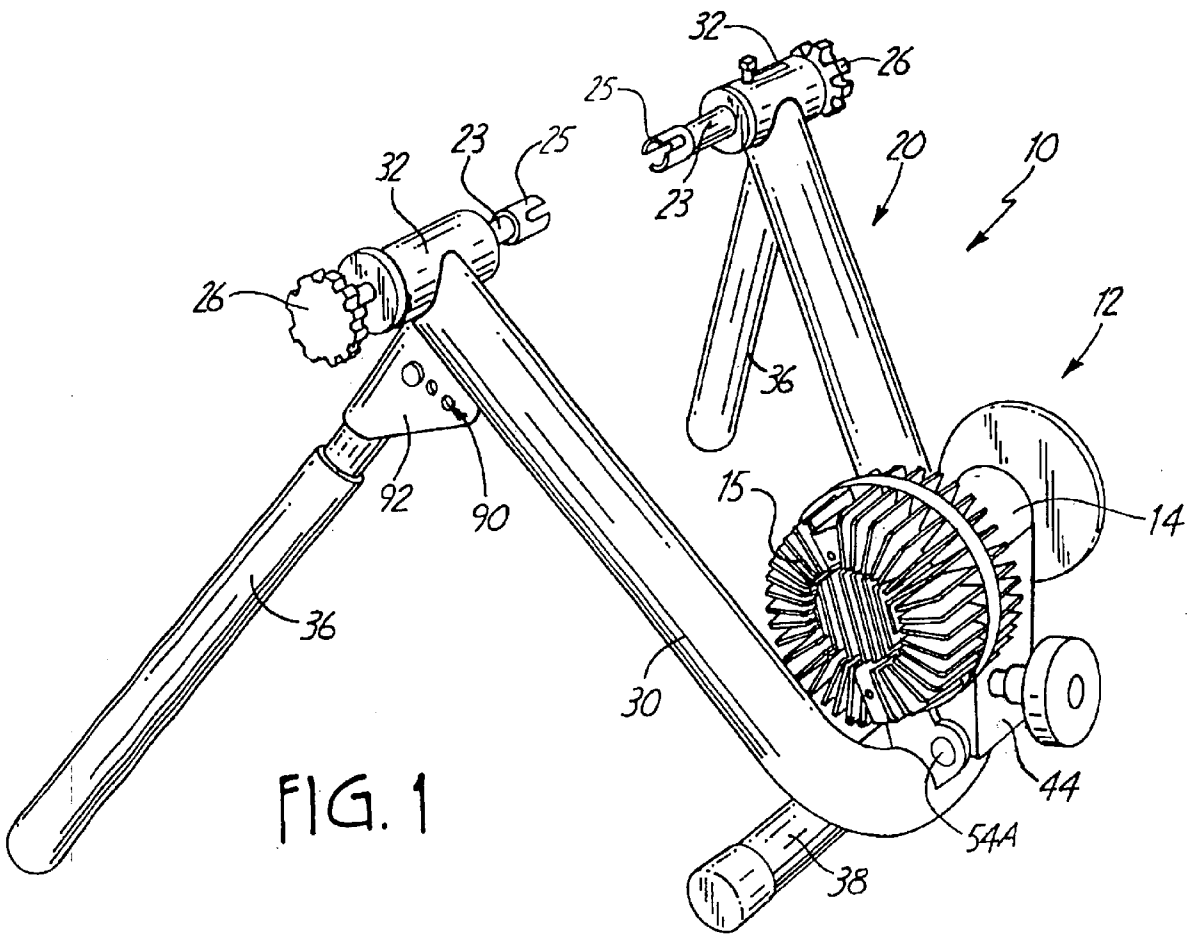
FIG. 1 is a perspective view of an exerciser.

An exemplary embodiment of an exerciser 10 with a movable resistance device 12 is illustrated in FIG. 1. As well known to those skilled in the art, the exerciser 10 is a bicycle trainer that is adapted to support a tire and wheel of a bicycle or other pedaled device (hereinafter "bicycle" by way of example, and used as a representation of all types of pedaled devices). The resistance device 12 includes a roller 14 that engages a tire of the bicycle. The resistance device 12 typically includes a rotatable resistance assembly 15 such as an impeller rotatable in a fluid such as oil. However, it should be understood that the present invention can be used with many forms of resistance devices wherein the specific implementation provided herein is not a part of the invention, and thus should not be limiting.

The exerciser 10 includes a frame 20 used to support the rotating wheel of the bicycle. In the exemplary embodiment illustrated, the frame 20 includes opposed support ends 32 that support couplers 25, for releasably supporting the bicycle above a floor. In this embodiment, the couplers 25 engage opposed portions of an axle of the bicycle. Each of the couplers 25 include rods 23 that threadably mate with threaded apertures in the frame 20. Handles 26 secured to the rods 23 adjust the couplers 25 axially to engage the bicycle. The manner in which the couplers 25 move relative to the frame 20 is merely exemplary, and other constructions can be used, if desired.

In the embodiment illustrated, the frame 20 includes a center portion 30 that is "U" or "V" shaped wherein the support ends 32 are spaced apart. Legs 36 are secured proximate the ends 32 and extend downwardly. In one embodiments the legs 36 are pivotally secured to the center portion 30 so as to allow the frame 20 to assure a compact position for storage. In this embodiment, the frame 20 further includes a horizontal support rod 38 joined to the center portion 30 that provides additional stability.

Figure 2:
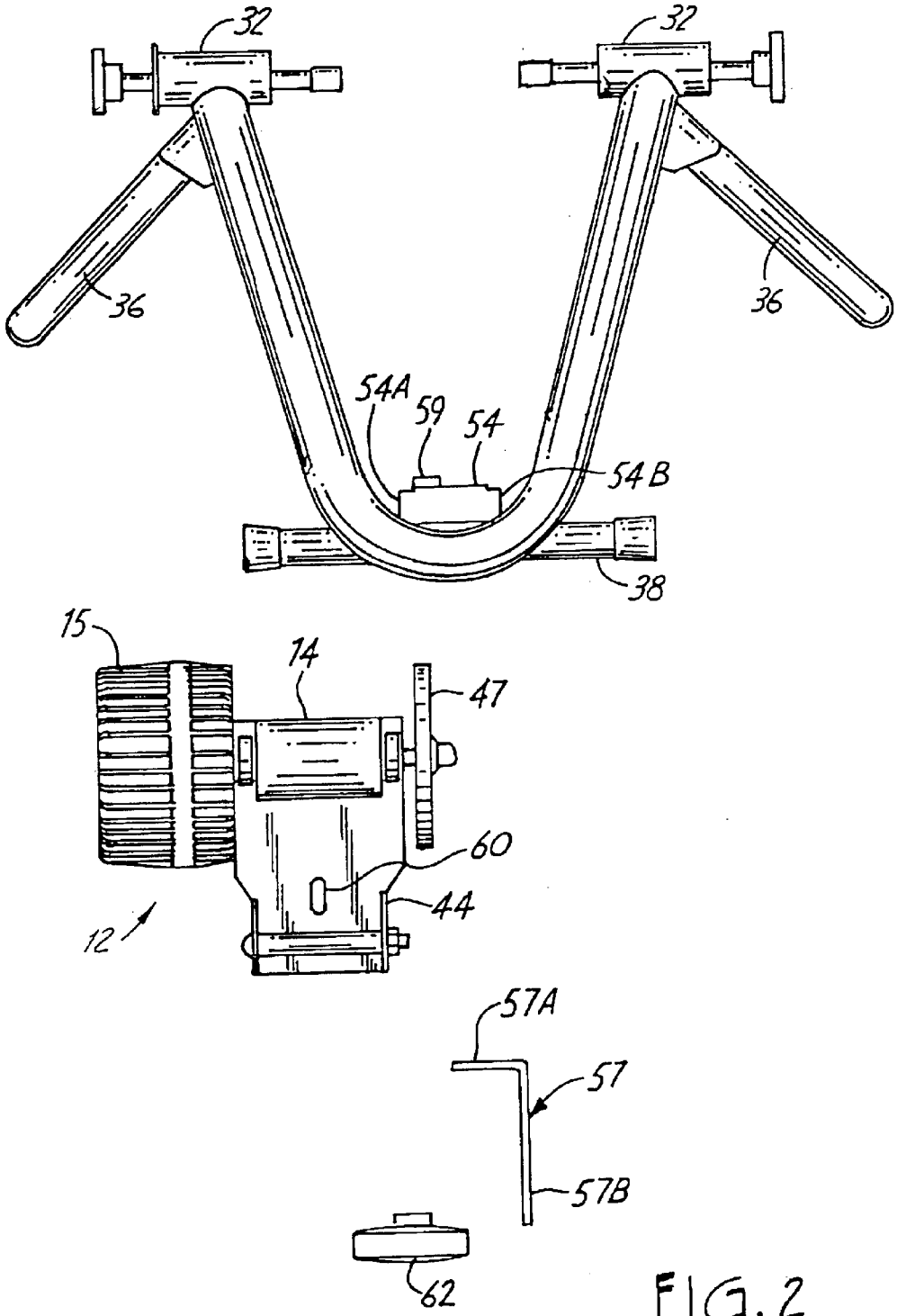
FIG. 2 is an exploded view of the exerciser without an adapter.
Figure 3:
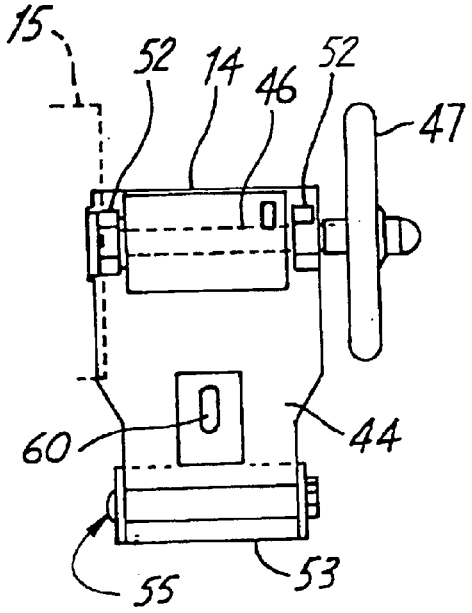
FIG. 3 is a view of a resistance device.
Figure 4:
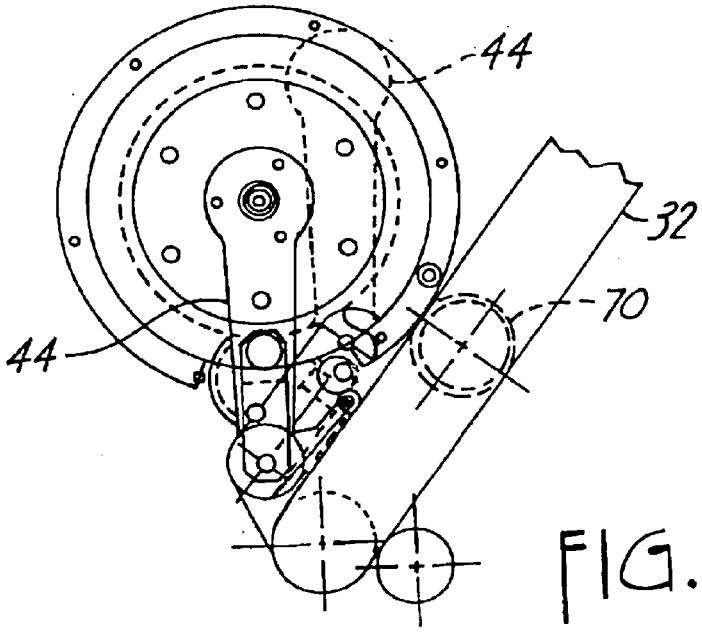
FIG. 4 is a side elevational view of the resistance device with a mounting bracket illustrated in two positions.
Figure 6:
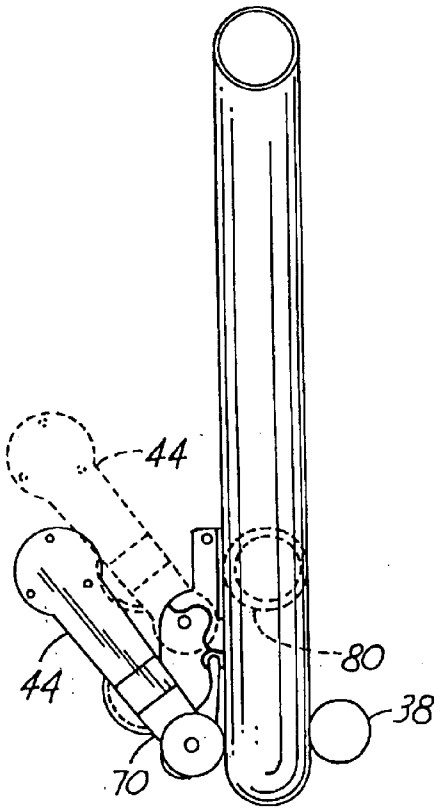
FIG. 6 is a side elevational view of a portion of the frame with the adapter and mounting bracket illustrated in two positions.
Figure 5:
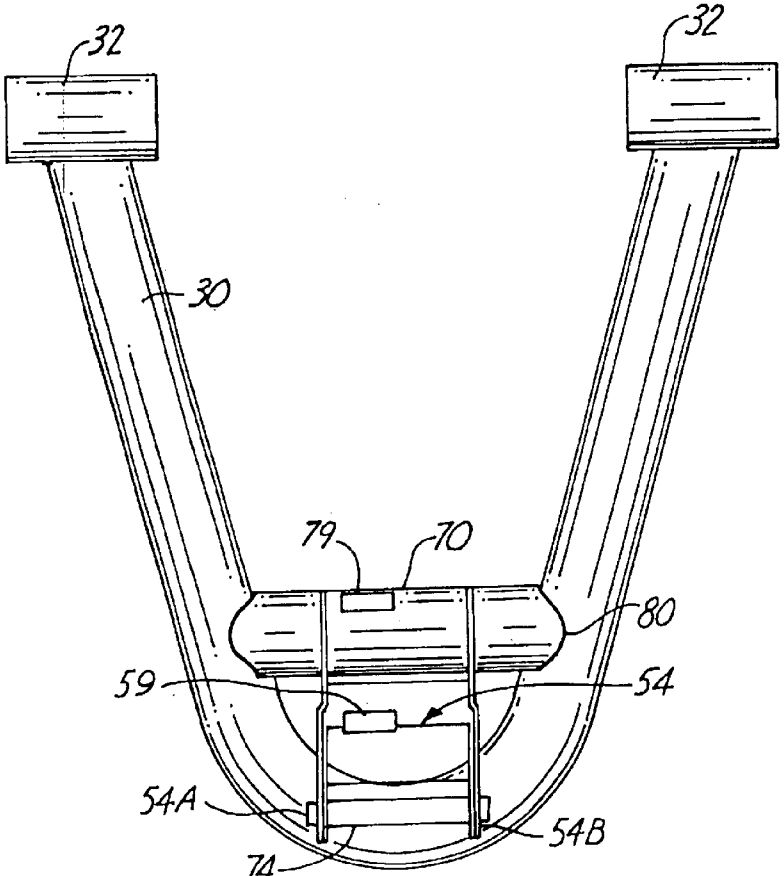
FIG. 5 is a front elevational view of a portion of a frame of the exerciser with the adapter.
Figure 9:
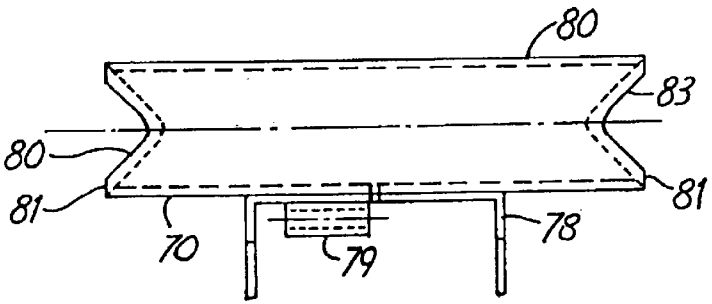
FIG. 9 is a top plan view of the adapter.
Figure 8:
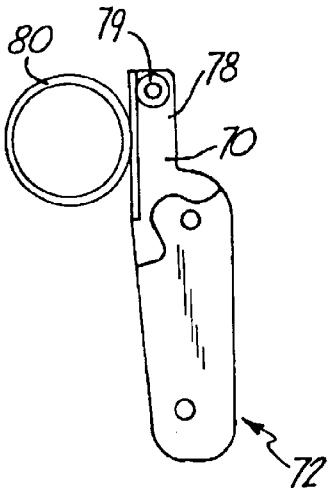
FIG. 8 is a side elevational view of the adapter.
Figure 7:
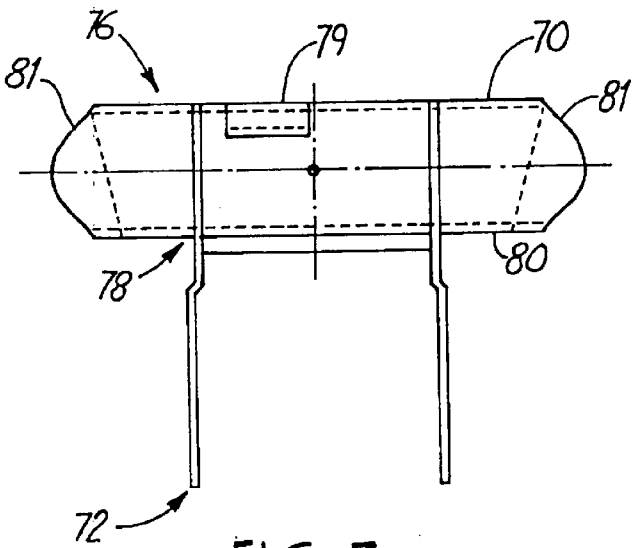
FIG. 7 is a front elevational view of the adapter.

Referring also to FIGS. 2 and 3, the resistance device 12 includes a mounting bracket 44. The mounting bracket 44 supports a shaft 46 of the resistance device 12 to which the roller 14 is secured. In the embodiment illustrated, the impeller unit 15 is mounted to a first end of the shaft 46, while a flywheel 47 is provided on an end opposite the impeller unit 15. Bearings 52 are provided to allow rotation of the shaft 46, and thereby, the roller 14 relative to the mounting bracket 44.

Figure 10:
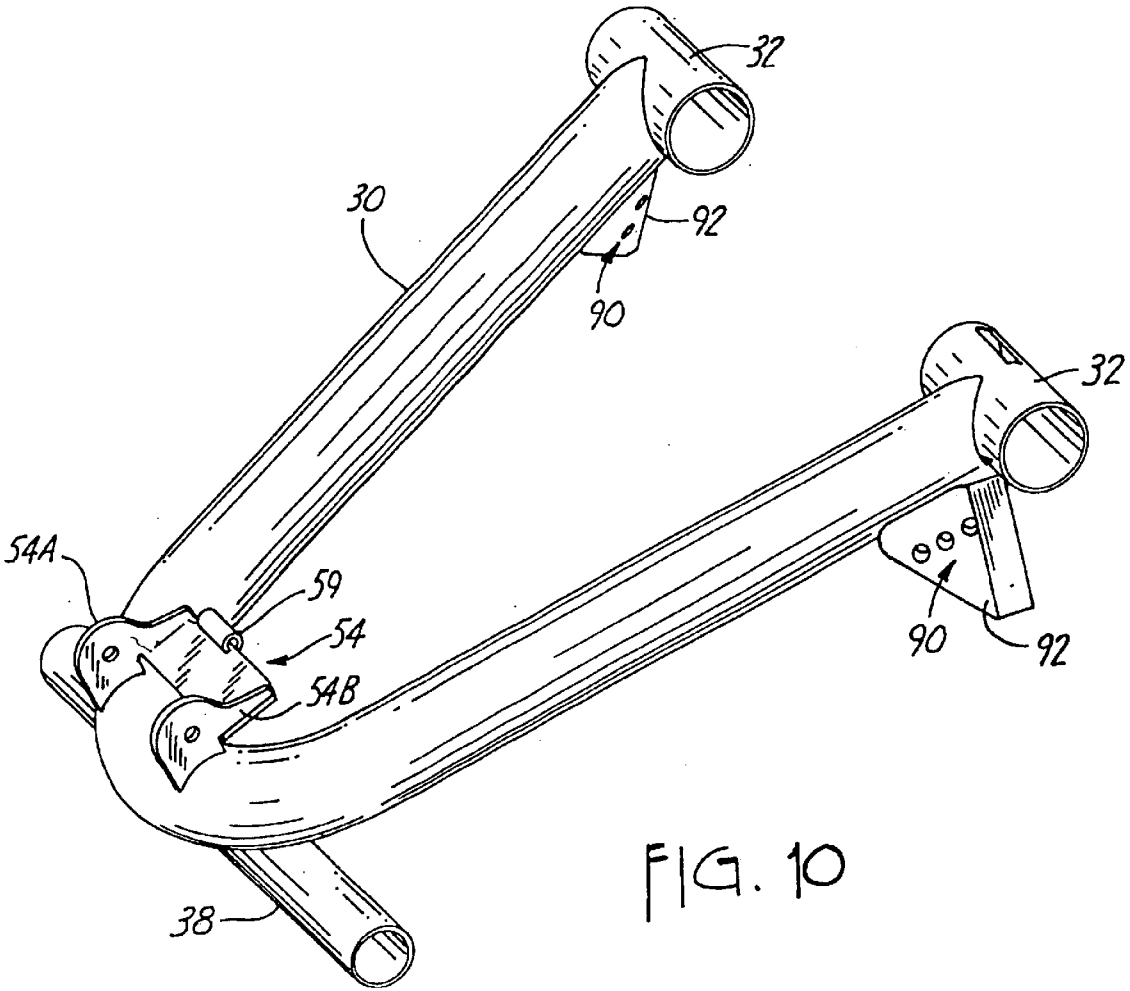
FIG. 10 is a perspective view of a portion of the frame.

The mounting bracket 44 can be secured to the frame 20 on an end 53 opposite the roller 14. Specifically, the mounting bracket 44 can be mounted to a frame mounting flange 54 (FIG. 10) that is secured to the center portion 30. In the embodiment illustrated, the frame mounting flange 54 comprises a pair of opposed ears 54A and 54B. A fastener 55, such as a threaded bolt herein illustrated in FIG. 3, can secure the mounting bracket 44 to the frame mounting flange 54. The fastener 55 extends through suitable apertures provided in the frame mounting flange 54 and the mounting bracket 44.

In order to provide some accommodation for wheels of different diameters, the mounting bracket 44 pivots relative to the frame 20. To adjust the position of the mounting bracket 44 and, thus, the resistance device 12, a threaded fastener 57 extends through an aperture 60 in the mounting bracket 44. In the embodiment illustrated, the fastener 57 comprises a "L"-shaped hook having a first portion 57A received in an aperture 59 provided on the frame 20. The portion 57A can pivot relative to the aperture 59. A second portion 57B of the fastener 57 is threaded and extends through the aperture 60 provided in the mounting bracket 44. A handle 62 threadably mates with the fastener 57 to hold the mounting bracket 44 in position wherein the resistance device 12 (i.e., the roller 14) engages the tire of the bicycle.

Although pivotal motion of the mounting bracket 44 relative to the frame mounting flange 54 allows wheels of different size to be used in the exerciser 10, the range of diameters is limited. Referring to FIGS. 3, 4 and 6–10, an adapter 70 selectively securable to the frame mounting flange 54 allows the resistance device 12 to be moved upwardly or closer to the support ends 32 in order that the exerciser 10 can be used with yet smaller wheels. In the embodiment illustrated, the adapter 70 includes a first end 72 having a width substantially similar to the end 53 of the mounting bracket 44 so as to be easily secured to the frame mounting flange 54. In this embodiment, the end 72 includes opposed ears having apertures to correspond with apertures provided in the ears 54A and 54B. A fastener 74, such as a threaded bolt and nut, secures the end 72 to the frame mounting flange 54. A second end 76 of the adapter 70 includes an adapter mounting flange 78 that is substantially similar to the frame mounting flange 54 so that the end 53 of the mounting bracket 44 can be easily mounted thereto when the adapter 70 is secured to the frame mounting flange 54. The fastener 55 secures the mounting bracket 44 to the adapter mounting flange 78. The adapter 70 includes an aperture 79 similar to the aperture 59 provided on the frame 20 to receive the first portion 57A of the fastener 57.

In the embodiment illustrated, the adapter 70 further includes a support 80 that releasably engages spaced apart portions of the frame 20 and, in particular, the center portion 30. As appreciated by those skilled in the art, the support 80 can take many forms. In the embodiment illustrated, each end 81 of the support 80 includes a recess 83 that receives the respective portion of the frame 20. The support 80 stabilizes the adapter 70 relative to the frame 20 and helps hold the adapter 70 in a fixed position.

As described above, the adapter 70 allows the exerciser 10 to accommodate bicycles or other pedaled devices having smaller wheels. In effect, the adapter 70 allows the resistance device 12 to be positioned closer to the support ends 32. In a further embodiment, it may be desirable that the support ends 32 be lowerable in the second position of the resistance device 12 using the adapter 70 in order that the bicycle or other pedaled device is substantially level and it center of gravity is as close to the floor as possible to avoid a tipping action, when operated. In order to adjust the height of the support ends relative to the floor, each of the legs 36 (FIGS. 1 and 10) are selectively fastened to the center portion 30 using one of a plurality of apertures 90 provided for each leg 36. In the embodiment illustrated, fastening of the leg 36 in each of the apertures 90 changes the angular position of the leg relative to the center portion 30 wherein larger angles effectively lower the height of the support ends 32 above the floor. Mounting flanges 92 on the center portion 30 include the plurality of apertures 90. However, those skilled in the art can appreciate that a similar flange can be secured to each of the legs 36, wherein the flanges on the legs 36 would include the plurality of apertures 90 in order to provide the necessary adjustment.

Likewise, other techniques for selectively lowering the ends 32 can be used and are considered other aspects of the present invention. For instance, each of the legs can be made selectively adjustable. Each leg can include portions that are connectable to form a desired length. For example, telescoping legs with a suitable fastener to selectively connect the leg portions to form a desired length can be used.

In summary, the adapter 70 allows the resistance device 12 to be easily positioned in one of two different positions on the exerciser 10 in order to accommodate varying wheel diameters. The adapter 70 is easy to manufacture and does not require alteration of the frame 20 from the existing design. Furthermore, the adapter 70 can be easily installed and removed, as desired.

Although the present invention has been described with reference to preferred embodiments, workers skilled in the art will recognize that changes may be made in form and detail without departing from the spirit and scope of the invention.

What is claimed is:

1. An exerciser adapted for use with a pedaled device, the exerciser comprising:

a frame having opposed support ends supporting the pedaled device and a frame mounting flange;

a resistance device selectively securable to the frame mounting flange in a first position relative to the opposed support ends; and an adapter selectively securable to the frame mounting flange and having an adapter mounting flange, wherein when the adapter is secured to the frame mounting flange, the resistance device is securable to the adapter mounting flange.

2. The exerciser of claim 1 wherein the frame mounting flange is substantially similar to the adapter mounting flange.

3. The exerciser of claim 2 wherein the frame mounting flange includes opposed mounting ears.

4. The exerciser of claim 3 wherein the adapter includes ends engagable with portions of the frame to provide stability.

5. The exerciser of claim 4 wherein each end of the adapter includes a recess for receiving a portion of the frame.

6. The exerciser of claim 1 and further comprising a mounting bolt and wherein the frame mounting flange, adapter mounting flange and the resistance device each include an aperture shaped to receive the bolt.

7. The exerciser of claim 1 wherein the frame includes a center portion for supporting the resistance device and a pair of extending legs, each leg being selectively securable to the center portion at different angular positions in order to adjust a height of the support ends relative to a floor.

8. The exerciser of claim 7 wherein the center portion includes a plurality of apertures proximate each of the legs for adjustably securing each of the legs to the center portion.

9. The exerciser of claim 1 wherein the resistance device is pivotally coupled to the adapter mounting flange.

10. The exerciser of claim 9 and further comprising a fastener couplable between the adapter mounting flange and the resistance device, the fastener adjusting the pivotal position of the resistance device and the adapter mounting flange.

11. The exerciser of claim 10 wherein the adapter mounting flange includes a first aperture and the resistance device includes a second aperture, and wherein a first end of the fastener is pivotally received in the first aperture and a second end of the fastener extends through the second aperture.

12. The exerciser of claim 11 wherein the frame mounting flange includes a third aperture similar in position to the first aperture so as to receive the first end of the fastener.

* * * * *